US009920927B2

(12) United States Patent
Desi-Seulean et al.

(10) Patent No.: US 9,920,927 B2
(45) Date of Patent: Mar. 20, 2018

(54) LOW NOX BURNER

(71) Applicant: Haul-All Equipment Ltd., Lethbridge (CA)

(72) Inventors: Sergiu Desi-Seulean, Lethbridge (CA); Jerry Ejdrygiewicz, Lethbridge (CA); David Neufeldt, Lethbridge (CA)

(73) Assignee: Haul-All Equipment Ltd., Lethbridge (CA)

( * ) Notice: Subject to any disclaimer, the term of this patent is extended or adjusted under 35 U.S.C. 154(b) by 765 days.

(21) Appl. No.: 13/965,681

(22) Filed: Aug. 13, 2013

(65) Prior Publication Data

US 2015/0050605 A1 Feb. 19, 2015

(51) Int. Cl.

| | |
|---|---|
| ***F23M 9/04*** | (2006.01) |
| ***F23D 14/62*** | (2006.01) |
| ***F23D 14/08*** | (2006.01) |
| ***F23D 14/36*** | (2006.01) |
| ***F23D 14/58*** | (2006.01) |
| *F23C 5/00* | (2006.01) |

(52) U.S. Cl.

CPC ..... *F23D 14/62* (2013.01); *F23D 14/085* (2013.01); *F23D 14/36* (2013.01); *F23D 14/58* (2013.01); *F23C 2201/20* (2013.01); *F23C 2900/06043* (2013.01); *F23D 2207/00* (2013.01); *F23D 2900/00003* (2013.01)

(58) Field of Classification Search

USPC ..... 431/8, 9, 115, 116, 350; 126/116 R; 60/776

See application file for complete search history.

(56) References Cited

U.S. PATENT DOCUMENTS

| | | | | | |
|---|---|---|---|---|---|
| 2,918,117 | A | * | 12/1959 | Griffin | F23C 9/006 431/116 |
| 3,565,345 | A | * | 2/1971 | Moltzan | C01B 33/183 239/132.3 |
| 4,014,639 | A | * | 3/1977 | Froehlich | F23D 11/24 239/406 |
| 4,230,445 | A | * | 10/1980 | Janssen | F23C 7/004 431/116 |
| 4,259,058 | A | * | 3/1981 | Gottwald | F23K 5/02 126/43 |
| 4,347,052 | A | * | 8/1982 | Reed | F23C 6/047 431/188 |
| 4,453,913 | A | * | 6/1984 | Gitman | F23D 14/34 431/174 |

(Continued)

*Primary Examiner* — Steven B McAllister
*Assistant Examiner* — Desmond C Peyton
(74) *Attorney, Agent, or Firm* — Dinsmore & Shohl, LLP

(57) ABSTRACT

A low NOx burner has a housing that includes a burner head defining a gas manifold and a primary flame zone downstream of the burner head. The burner has a gas inlet for receiving gas. Flow-through air vents are disposed around a center of the burner head and extending through the burner head thereby enabling cold core air to flow from an annular core space upstream of the burner head to the primary flame zone downstream of the burner head. The burner also includes a plurality of premix air vents in fluid communication with the manifold for premixing air and gas within the manifold and for emitting premixed air and gas into the primary flame zone. A plurality of staging pipes extend from the manifold into the primary flame zone for conveying gas into the primary flame zone. The burner includes an ignition device extending into the primary flame zone.

25 Claims, 7 Drawing Sheets

(56) References Cited

U.S. PATENT DOCUMENTS 5,098,282 A * 3/1992 Schwartz ..... F23C 6/047 431/116
5,240,410 A * 8/1993 Yang ..... F23D 17/002 239/400
5,275,554 A * 1/1994 Faulkner ..... F23C 1/08 431/115
5,338,186 A * 8/1994 Sulzhik ..... F23D 14/125 431/115
5,415,539 A * 5/1995 Musil ..... F23C 7/004 239/404
5,624,253 A * 4/1997 Sulzhik ..... F23C 9/00 431/116
5,882,184 A * 3/1999 Feldermann ..... F23D 14/24 239/424.5
6,059,566 A * 5/2000 Cummings, III ..... F23D 14/02 239/434
6,071,115 A * 6/2000 Carbone ..... F23C 9/08 431/10
6,095,798 A * 8/2000 Mitani ..... F23C 3/002 431/11
7,066,728 B2 * 6/2006 Chatel-Pelage ..... F23D 1/00 431/183
7,137,258 B2 * 11/2006 Widener ..... F23R 3/286 60/737
8,011,360 B2 * 9/2011 Desi-Seulean ..... F24H 3/087 110/302
2001/0010896 A1 * 8/2001 Nagayama ..... F23C 9/006 431/10
2002/0162333 A1 * 11/2002 Zelina ..... F23R 3/14 60/776
2003/0190570 A1 * 10/2003 Jones ..... F23C 6/047 431/8
2004/0011054 A1 * 1/2004 Inoue ..... F23R 3/10 60/776

* cited by examiner

LOW NOX BURNER

CROSS-REFERENCE TO RELATED APPLICATIONS

This is the first application filed for the present invention.

TECHNICAL FIELD

The present invention relates generally to burning and combusting of hydrocarbons and, in particular, to burners or combustors for heaters.

BACKGROUND

Burning hydrocarbons in air produces NOx (mono-nitrogen oxides such as nitrogen oxide and nitrogen dioxide). NOx emissions are known to be deleterious for the ozone in the stratosphere. Atmospheric NOx also forms nitric acid, which contributes to acid rain. Because of these significant environmental concerns, it is highly desirable to reduce NOx emissions in the burning or combustion of hydrocarbon fuels. Furthermore, in some jurisdictions, environmental regulations limit the amount of NOx emissions that a burner may emit.

SUMMARY

In general, the present invention provides a low NOx burner, i.e. a burner that emits reduced NOx.

Accordingly, one aspect of the present invention is a burner having a housing that includes a burner head defining a gas manifold including an upstream wall, a downstream wall, and a sidewall and a primary flame zone downstream of the burner head, a gas inlet in the burner head for connecting to and receiving gas from a gas line, a plurality of flow-through air vents disposed around a center of the burner head and extending as continuous passageways through the gas manifold of the the burner head thereby enabling cold core air to flow from an annular core space upstream of the burner head to the primary flame zone downstream of the burner head, a plurality of premix air vents in fluid communication with the manifold for premixing air and gas within the manifold and for emitting premixed air and gas into the primary flame zone, a plurality of staging pipes extending in fluid communication with and from the manifold into the primary flame zone for conveying gas into the primary flame zone, and an ignition device extending into the primary flame zone.

Another aspect of the present invention is a heater including a burner that has a blower and a burner. The burner has a housing that includes a burner head defining a gas manifold including an upstream wall, a downstream wall, and a sidewall and a primary flame zone downstream of the burner head, a gas inlet in the burner head for connecting to and receiving gas from a gas line, a plurality of flow-through air vents disposed around a center of the burner head and extending as continuous passageways through the gas manifold of the burner head thereby enabling cold core air to flow from an annular core space upstream of the burner head to the primary flame zone downstream of the burner head, a plurality of premix air vents in fluid communication with the manifold for premixing air and gas within the manifold and for emitting premixed air and gas into the primary flame zone, a plurality of staging pipes extending in fluid communication with and from the manifold into the primary flame zone for conveying gas into the primary flame zone, and an ignition device extending into the primary flame zone.

Yet another aspect of the present invention is a method of burning a combustible hydrocarbon gas in air while minimizing the emission of NOx. The method entails supplying the combustible hydrocarbon gas through a gas inlet to a burner head defining a gas manifold including an upstream wall, a downstream wall, and a sidewall through which the gas flows into a primary flame zone downstream of the burner head through a plurality of staging pipes extending in fluid communication with and from the manifold into the primary flame zone, flowing air through a plurality of flow-through air vents disposed in the burner head around a center of the burner head enabling cold core air to flow from an annular core space upstream of the burner head through continuous passageways in the gas manifold of the burner head to the primary flame zone downstream of the burner head, premixing a portion of the gas entering the manifold with air and emitting premixed air and gas into the primary flame zone, and igniting the gas and air in the primary flame zone.

The details and particulars of these aspects of the invention will now be described below, by way of example, with reference to the attached drawings.

BRIEF DESCRIPTION OF THE DRAWINGS

Further features and advantages of the present technology will become apparent from the following detailed description, taken in combination with the appended drawings, in which.

It will be noted that throughout the appended drawings, like features are identified by like reference numerals.

DETAILED DESCRIPTION

Figure 1:
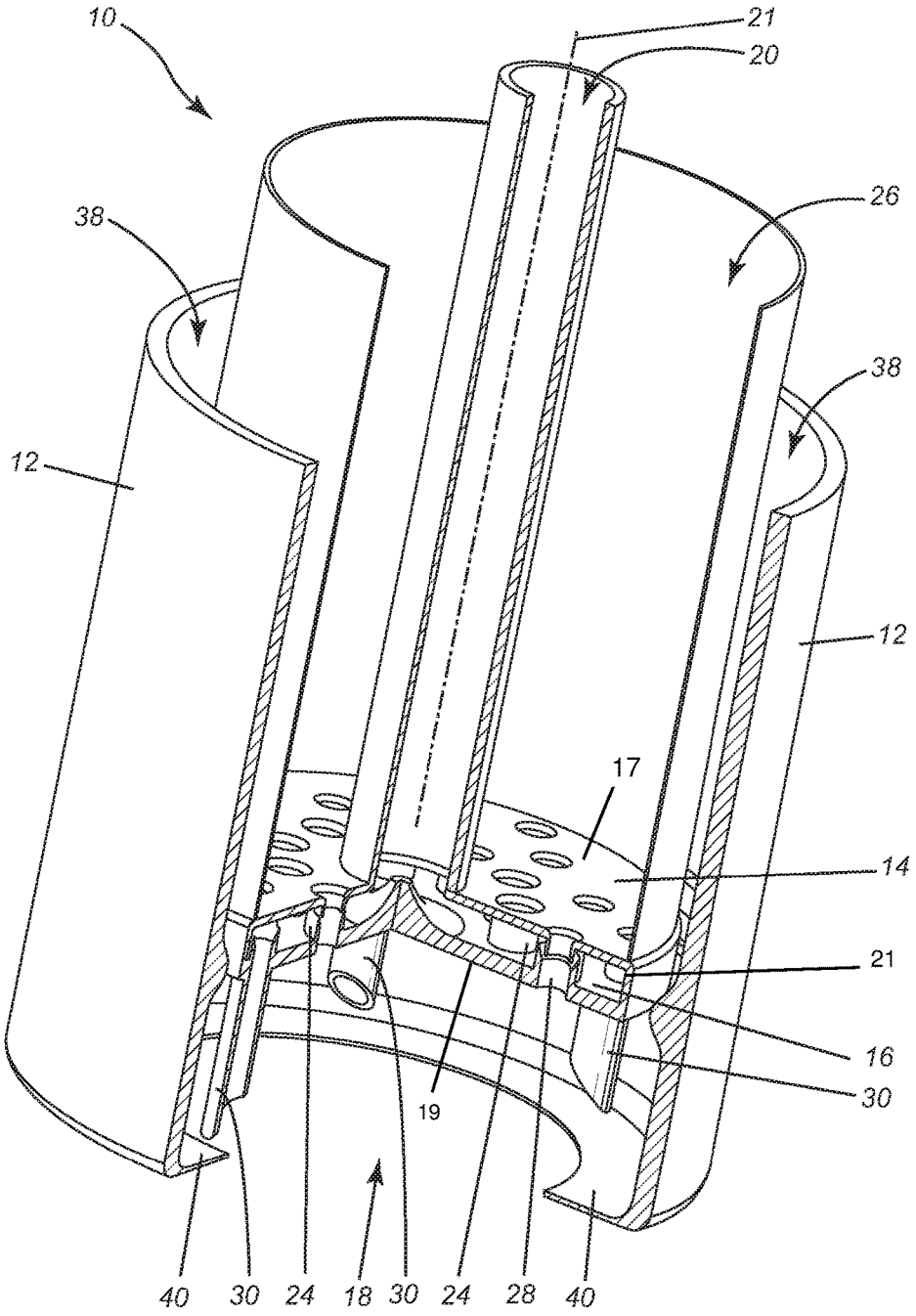
FIG. 1 is an isometric cutaway view of a burner in accordance with an embodiment of the present invention.

A burner, generally designated by reference numeral 10, is illustrated by way of example in FIG. 1. The burner 10 has a housing 12 that includes a burner head 14 defining a gas manifold 16 and a primary flame zone 18 downstream of the burner head. The gas manifold 16 includes an upstream wall 17, a downstream wall 19, and a sidewall 21. The burner 10 includes a gas inlet 20 in the burner head for connecting to and receiving a combustible hydrocarbon gas from a gas line 22 (not shown in FIG. 1 but visible in FIGS. 5, 8 and 9). As depicted in the illustrated embodiment, the gas inlet 20 defines a tubular passage extending longitudinally along a central axis 21 of the housing. The gas inlet may be a central gas inlet as shown by way of example in the drawings although the gas inlet need not be central to the burner head.

For the purposes of this specification, the expression "combustible hydrocarbon gas" (herein referred to simply as "gas") is meant to include any flammable vapour state hydrocarbon gas or combustible petroleum product such as propane, natural gas, butane, methane, or any other petroleum gas, or alcohol-based fuels such as ethanol, etc.

Figure 2:
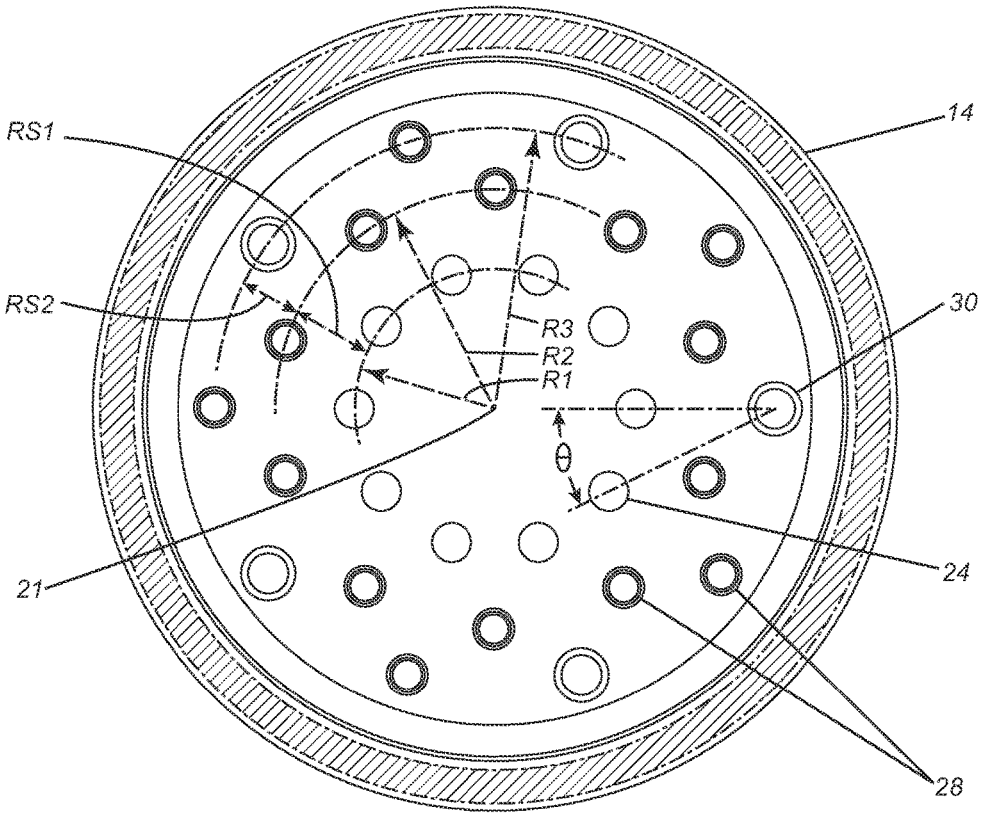
FIG. 2 is bottom view of a burner head for the burner of FIG. 1.

FIG. 2 depicts a bottom view of a burner head 14 in accordance with one embodiment of the present invention. As depicted in FIG. 1 and FIG. 2, the burner head 14 includes a plurality of flow-through air vents 24 disposed around a center of the burner and extending as continuous passageways through the gas manifold of the burner head the burner head thereby enabling cold core air (primary air) to flow from an annular core space 26 upstream of the burner head to the primary flame zone 18 downstream of the burner head 14. The flow-through air vents 24 are continuous passageways or conduits through the manifold between the annular core space 26 and the primary flame zone 18. The burner includes a plurality of premix air vents 28 in fluid communication with the manifold 16 for premixing air and gas within the manifold and for emitting premixed air and gas into the primary flame zone 18. The premix air vents 28 are discontinuous passageways or conduits having openings or apertures into which gas is drawn from the manifold. The burner includes a plurality of staging pipes 30 extending in fluid communication with and from the manifold into the primary flame zone 18 for conveying gas into the primary flame zone 18. Secondary air flows through an annular air passageway 38. The burner includes a secondary air deflector 40 (or collar) for deflecting the secondary air into the primary flame zone 18 and into close proximity with the gas from the staging pipes 30. The burner includes an ignition device 32 (shown in FIG. 5) extending into the primary flame zone. In the illustrated embodiment, the ignition device 32 is a flame rod although any other suitable igniter may be employed.

Figure 3:
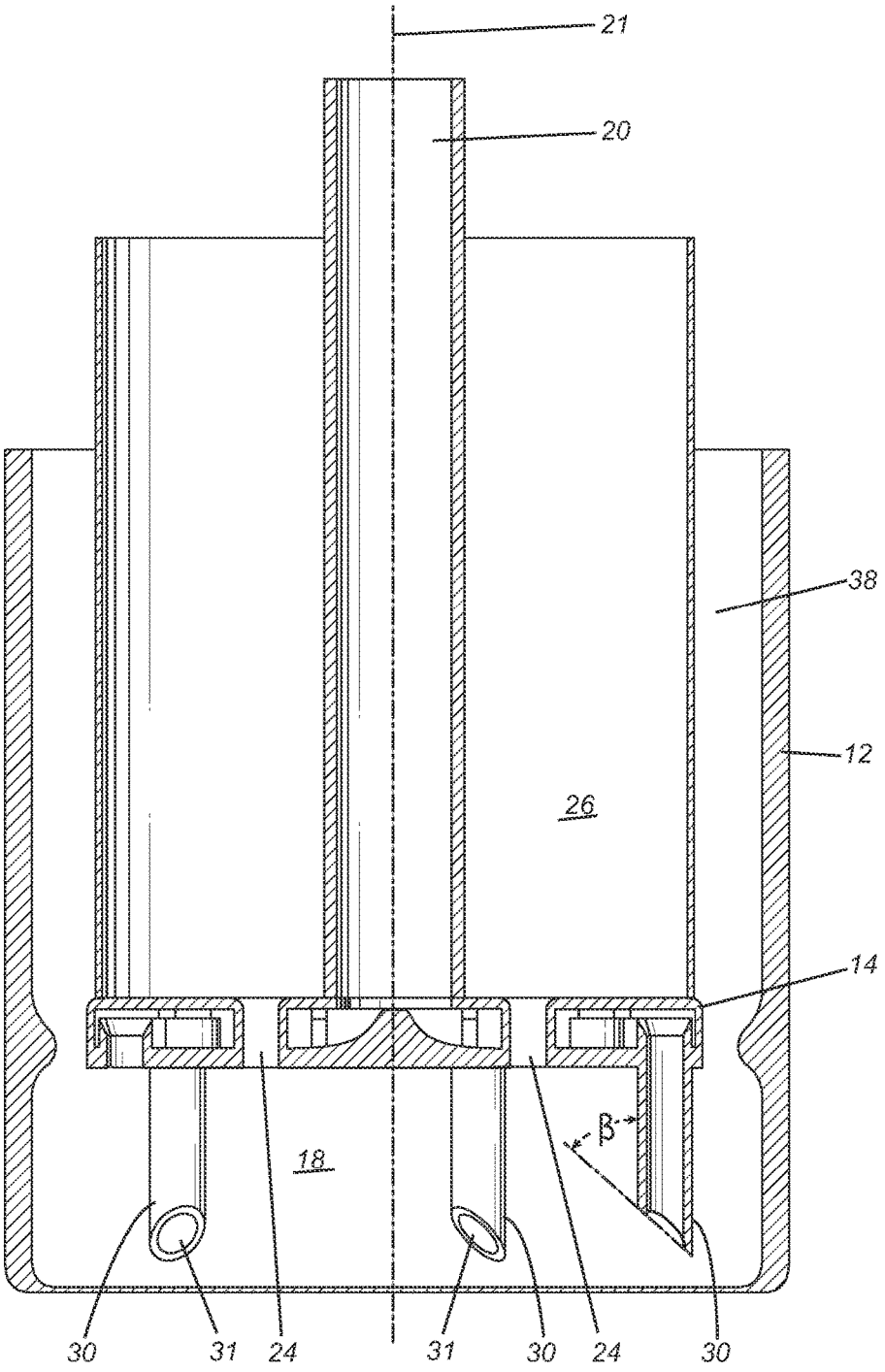
FIG. 3 is a vertical cross-sectional view of the burner head of FIG. 2.
Figure 4:
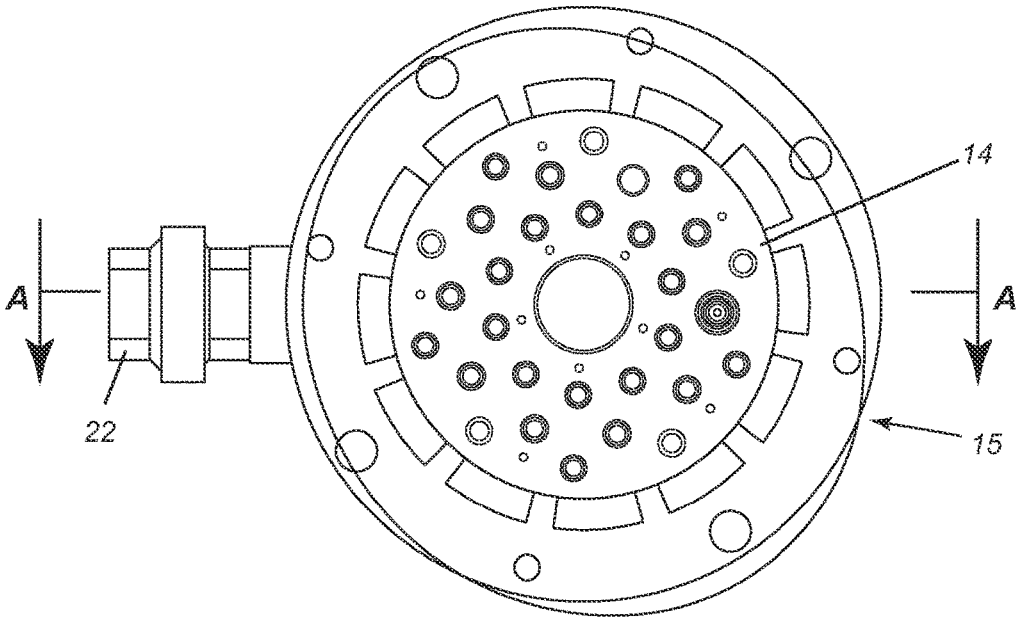
FIG. 4 is a bottom view of a burner head assembly for the burner of FIG. 1.

In the embodiment illustrated by way of example in FIGS. 1-3, the housing 12 is a cylindrical (or tubular) housing and the burner head 14 may be in the form of a circular head plate for mounting within the cylindrical housing. In this illustrated embodiment, the premix air vents 28 are disposed radially outwardly of the flow-through air vents 24 and the staging pipes 30 are disposed radially outwardly of some of the premix air vents 28.

As further illustrated by way of example in FIGS. 1-3, the flow-through air vents 24, premix air vents 28 and staging pipes 30 are disposed in concentric circular arrangements around the gas inlet 20. In other words, the flow-through air vents 24 define a first circle of a first radius R1, some of the premix air vents 28 define a second circle of a second radius R2 (where R2>R1) and the staging pipes 30 define a third circle of a third radius R3 (where R3>R2). Additional premix air vents 28 may be included in the third circle as shown in the embodiment depicted in FIG. 2. The radial spacing RS1 between the first circle of radius R1 and the second circle of radius R2 (RS1=R2−R1) may be equal to the radial spacing RS2 between the second circle of radius R2 and the third circle of radius R3 (RS2=R3−R2). In other embodiments, the radial spacing RS1 may be greater than RS2. In yet other embodiments, RS2 may be greater than RS1. In other embodiments, there may be more than three rings of vents and staging pipes. Also the spacing between the vents and staging pipes can vary, i.e. the radii R1, R2 and R3 may be varied. In most implementations, there are three zones—a fresh air zone at radius R1, a secondary fresh air zone in the annular air passage 38 (beyond the edge of the burner head), and a premix zone between the other two zones. The figures show one ring of vents in the central fresh air zone, and two rings in the premix zone, but there could be more in each of these zones. The staging pipes start in the premix zone and extend through the primary flame zone up to the secondary air deflector/collar 40.

Although FIGS. 1-3 show one specific arrangement having ten flow-through air vents, fifteen premix air vents, and five staging pipes, the number of flow-through air vents, premix air vents and staging pipes may be varied. Similarly, in the embodiment of FIGS. 1-3, there is a 1:1.5 ratio between flow-through air vents and premix air vents and a 3:1 ratio between premix air vents and staging pipes. In other words, the number of flow-through air vents is less than the number of premix air vents whereas the number of premix air vents is triple the number of staging pipes. However, in other embodiments, the ratios may be different. In the illustrated embodiment of FIGS. 1-3, the flow-through air vents and premix air vents are equally angularly spaced at successive angles of 36 degrees. As illustrated, the flow-through air vents are radially offset relative to the premix air vents. As shown in the embodiment of FIGS. 1-3, the staging pipes are evenly distributed with a successive angular spacing of 72 degrees although this may be varied in other embodiments. However, in other embodiments, the angular spacing and radial alignments may be varied. The diameters of the flow-through air vents, premix air vents and staging pipes may be substantially equal or unequal. The gas inlet 20 may have a larger diameter than the diameter of any of the individual gas outlets or staging pipes, as shown in the figures. As shown in FIGS. 1-3, the burner head may include five staging pipes 30.

To promote turbulent mixing, outlets 31 of each respective staging pipe 30 may be bevelled at an angle $\beta$ of 30-90 degrees from a transverse plane through the pipe. As well, the bevelled outlets are oriented at an angle $\theta$ of 25-60 degrees relative to a radial line extending from the respective staging pipe to the center of the burner head. The outlets 31 are so oriented in order to swirl the gas emitted by the staging pipes 30. In the specific embodiment illustrated in FIGS. 1-9, the outlets 31 are at an angle $\theta$ of 30 degrees relative to the radial line. The angle $\beta$ is depicted in FIG. 3 and the angle $\theta$ is depicted in FIG. 2.

In one embodiment, the outlets 31 are bevelled at an angle $\beta$ of 40-50 degrees as illustrated in FIG. 1. In the specific embodiment illustrated in FIG. 3 and FIG. 9, the outlets 31 are bevelled at an angle $\beta$ of 45 degrees.

FIGS. 4-7 depict the burner head assembly which includes the burner head 14, gas line assembly (including gas line 22), flame sensor 42 and flame rod 32. As illustrated by way of example in these figures, the burner may include the circumferential or annular air passage 38 for secondary air to flow at the circumference around the burner. The primary (core) air and secondary air may be cold or preheated air or it may be air mixed with exhaust. It may be possible to recirculate exhaust gases back into the fresh air flow. When mixing exhaust with the primary or secondary air, the exhaust may be taken from a combustion chamber or any point downstream from there.

This burner may operate vertically, horizontally or in any other spatial orientation.

The burner may be constructed of stainless steel or any other equivalent or suitable material. The surfaces of the burner exposed to extreme heat (i.e. the primary flame zone and bottom face of the burner head) may furthermore be coated with a heat-resistant coating to prolong service life.

Figure 8:
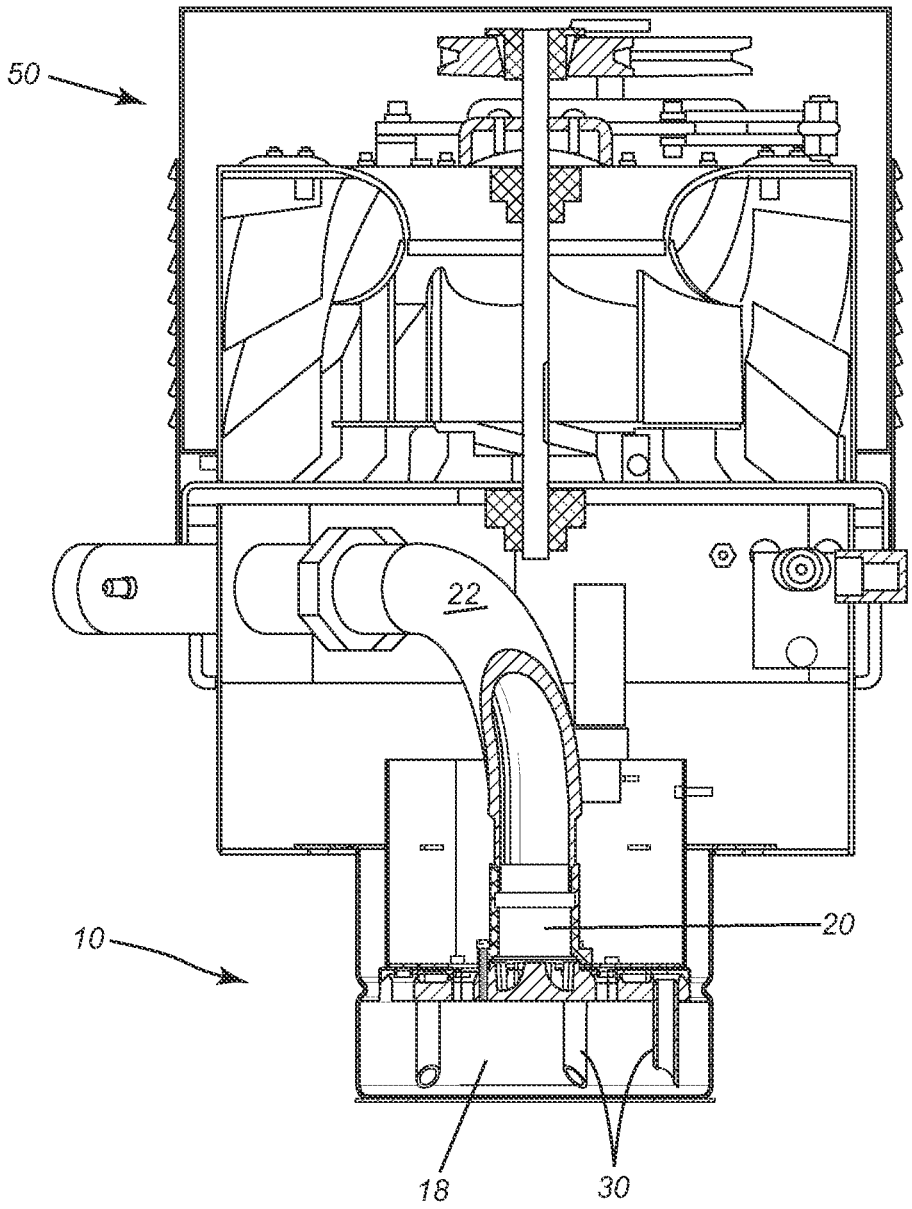
FIG. 8 is a cross-sectional view of the burner of FIG. 1 connected to a blower.

The burner may be used, or adapted for use, in a heater equipped with a blower 50 such as the one depicted by way of example in FIG. 8. The heater may be a direct heater (in which combustion gases are exhausted directly into a space to be heated) or an indirect heater (in which a heat exchanger is used to transfer heat from the combustion gases to the space to be heated). For example, the burner may be used in a construction heater or space heater. The burner may be used as part of a boiler, steam generator, oven (e.g. curing oven), paint booth, etc. The burner may be used in a variety of other applications such as in steel treating or other processes where heat is required.

Figure 5:
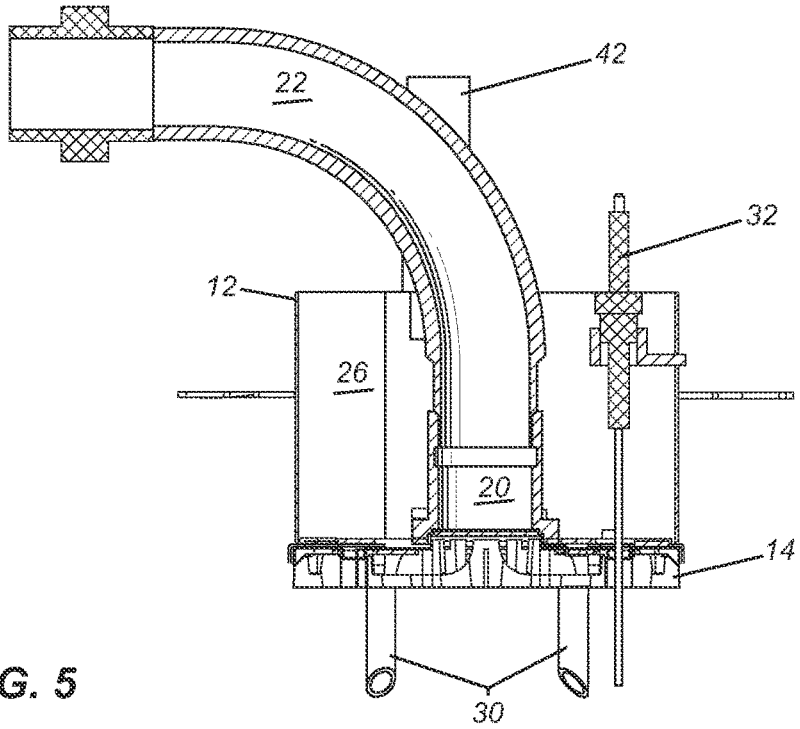
FIG. 5 is a sectional view (Section A-A) of the burner head assembly taken through section A-A in FIG. 4.
Figure 6:
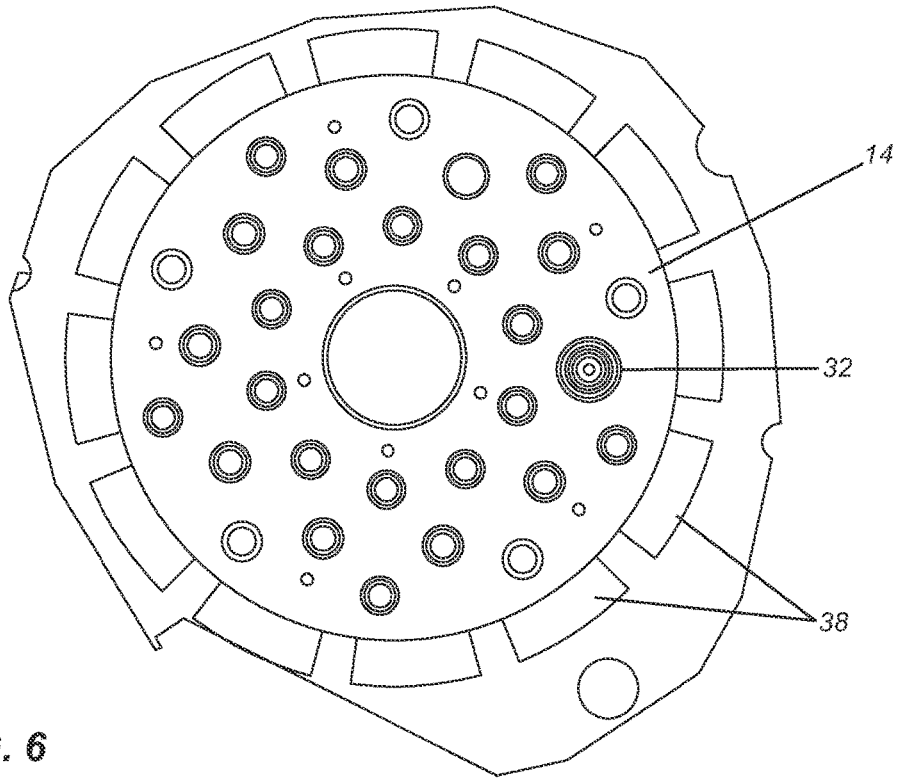
FIG. 6 is a detailed bottom view (Detail B) of the burner head assembly of FIG. 4.
Figure 7:
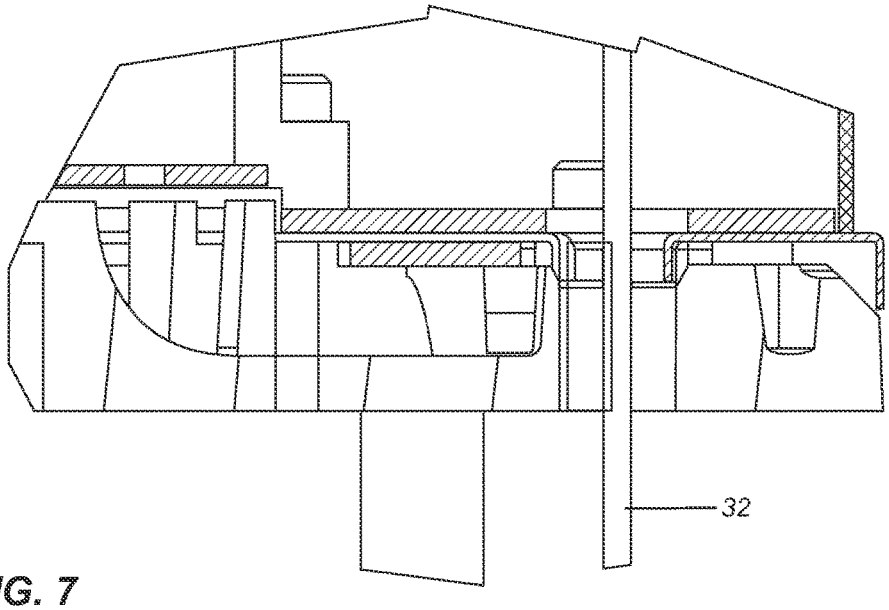
FIG. 7 is a detailed cross-sectional view (Detail C) of a portion of the burner head assembly shown in FIG. 5.
Figure 9:
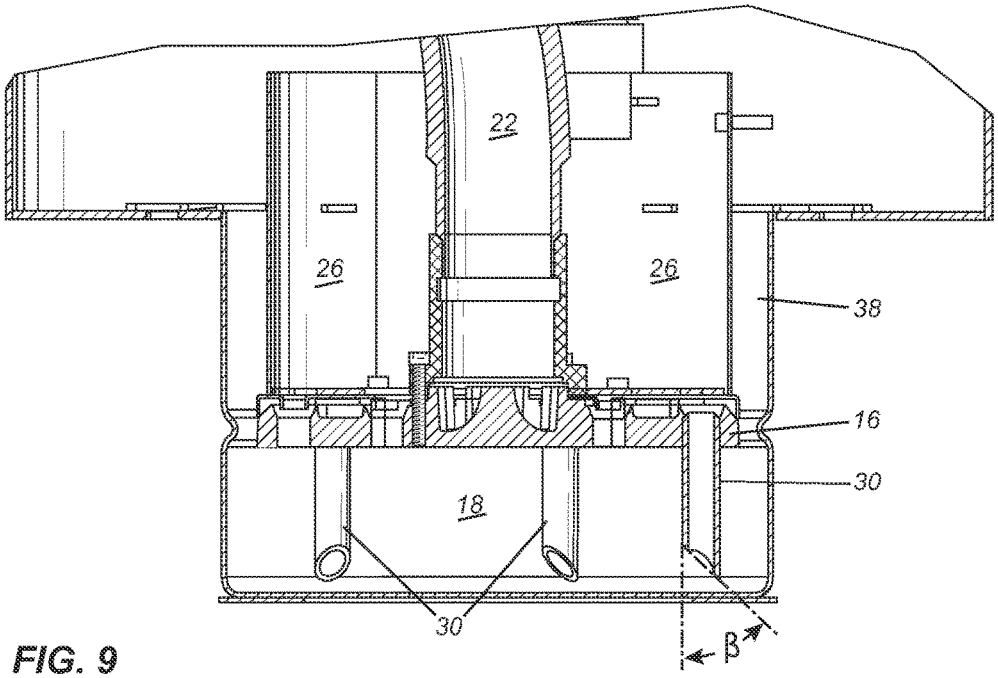
FIG. 9 is a detailed cross-sectional view (Detail D) of the burner in FIG. 8.

FIGS. 8 and 9 show how the blower 50 may be interfaced with the novel burner 10. The blower can be belt-driven, direct-drive, or other drive mechanism. The heater may further include a flame sensor 42 disposed on the gas line 22 as shown in FIG. 5. The flame sensor may be an ultraviolet (UV) flame sensor capable of detecting UV radiation emitted at the instant of ignition although other types of flame sensors may be used or adapted for use.

The burner also enables a method of burning a combustible hydrocarbon gas in air while producing reduced NOx emissions. The method entails supplying the combustible hydrocarbon gas through a gas inlet to a burner head defining a gas manifold through which the gas flows into a primary flame zone downstream of the burner head through a plurality of staging pipes extending from the manifold into the primary flame zone, flowing air through a plurality of flow-through air vents disposed in the burner head around a center of the burner head enabling cold core air to flow from an annular core space upstream of the burner head to the primary flame zone downstream of the burner head, premixing a portion of the gas entering the manifold with air and emitting premixed air and gas into the primary flame zone, and igniting the gas and air in the primary flame zone.

In one embodiment of the method, supplying the gas involves swirling the gas exiting the outlets of each respective staging pipe by orienting the outlets at 25-60 degrees, more particularly 25-35 degrees relative to a radial line extending from the respective staging pipe to a center of the burner head. Supplying the gas may also entail directing the gas exiting the outlets of each respective staging pipe in the burner at an angle by beveling the outlets at 30-90 degrees or more particularly at 40-50 degrees. In one specific embodiment, the method may be performed by swirling the gas using staging pipes that have outlets oriented at 30 degrees to the radial line and being beveled at 45 degrees. Premixing may be performed, in one embodiment, by using premix air vents that are disposed radially outwardly of the flow-through air vents so that the supplying of the gas is performed by the staging pipes that are disposed radially outwardly of the premix air vents.

The burner produces low NOx emissions in a compact design. The shorter length of the burner provides for a more compact heater with a superior power density relative to axially staged burners. The injection of air via the flow-through air vents 24 has the effect of cooling the core of the flame, thereby reducing the amount of NOx being produced in the primary flame zone. Tests have demonstrated emissions in the range of 9-19 ppm NOx for a burner embodying the invention whereas a conventional comparable burner would produce approximately 100 ppm NOx.

Figure 10:
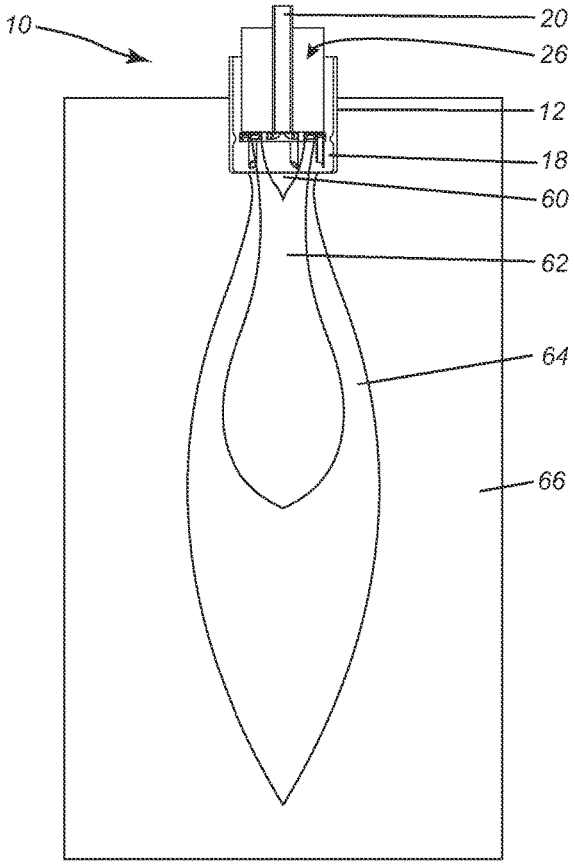
FIG. 10 is a fuel concentration diagram showing the flame zones of varying air/fuel mixtures.

FIG. 10 is a fuel concentration diagram showing the approximate flame zones of varying air/fuel mixtures. In this diagram, there are three discrete flame zones illustrated, a first zone 60, a second zone 62 and a third zone 64 with the combustion chamber 66. The first zone receives flow-through air and is confined within the second zone. The first zone is almost entirely air, with some gas drawn in from the second zone through recirculation. The second zone 62 is confined within the third zone and receives an extremely rich mixture of gas and air from the premix air vents 28. The combustion in this zone produces a high amount of CO because there is insufficient oxygen in this zone to achieve complete combustion. Because of lack of oxygen, the temperature of the second zone is reduced and the volume of the second zone enlarged. This allows the cracking of the fuel to form CO and CH radicals with minimal formation of NOx. The third zone 64 receives gas through the staging pipes and air from the secondary air, deflected by the secondary air deflector 40. Although the overall ratio of gas and air in this zone is lean, the mixture near the outlet of each staging pipe is rich. This results in micro zones of high CO and low NOx at the outlet of each staging pipe. The third zone completes the combustion of second zone and the micro zones of the staging pipes over a shortened period of time and at a lower temperature to substantially prevent, or at least minimize, the formation of NOx while keeping the CO levels low.

This invention has been described in terms of specific examples, embodiments, implementations and configurations which are intended to be exemplary only. Persons of ordinary skill in the art will appreciate that obvious variations, modifications and refinements may be made without departing from the scope of the present invention. The scope of the exclusive right sought by the Applicant is therefore intended to be limited solely by the appended claims.

What is claimed is:

1. A burner comprising:

a housing that includes a burner head defining a gas manifold including an upstream wall, a downstream wall, and a sidewall and a primary flame zone downstream of the burner head;

a gas inlet in the gas manifold of the burner head for connecting to and receiving gas from a gas line;

a plurality of flow-through air vents disposed around a center of the burner head and extending as continuous passageways through the gas manifold of the burner head thereby enabling core air to flow, without mixing with the gas, from an annular core space upstream of the burner head to the primary flame zone downstream of the burner head;

a plurality of premix air vents in fluid communication with the gas manifold so as to receive gas from the gas manifold for premixing air from the annular core space and gas within the gas manifold and for emitting premixed the air from the annular core space and gas into the primary flame zone;

a plurality of staging pipes extending in fluid communication with and from the gas manifold into the primary flame zone for conveying gas into the primary flame zone; and an ignition device in the primary flame zone.

2. The burner as claimed in claim 1 wherein the burner head comprises a circular head plate for mounting within a cylindrical housing and wherein the premix air vents are disposed radially outwardly of the flow-through air vents and wherein the staging pipes are disposed radially outwardly of the premix air vents.

3. The burner as claimed in claim 2 wherein the flow-through air vents, premix air vents and staging pipes are disposed in concentric circular arrangements around a center of the burner head.

4. The burner as claimed in claim 1 wherein outlets of each respective staging pipe are oriented at 25-60 degrees relative to a radial line extending from the respective staging pipe to a center of the plate, the outlets being oriented to swirl the gas emitted by the pipes.

5. The burner as claimed in claim 4 wherein outlets of each respective staging pipe are oriented at 30 degrees relative to a radial line extending from the respective staging pipe to a center of the burner head, the outlets being oriented to swirl the gas emitted by the pipes.

6. The burner as claimed in claim 4 wherein the outlets are further bevelled at 30-90 degrees.

7. The burner as claimed in claim 5 wherein the outlets are further bevelled at 40-50 degrees.

8. The burner as claimed in claim 6 wherein the outlets are further bevelled at 45 degrees.

9. The burner as claimed in claim 1 further comprising an annular air passage for secondary air to flow.

10. The burner as claimed in claim 9 further comprising a secondary air deflector for deflecting secondary air radially inwardly into the primary flame zone and into close proximity with gas emitted from the staging pipes.

11. A heater comprising:

a blower; and a burner comprising:

a housing that includes a burner head defining a gas manifold including an upstream wall, a downstream wall, and a sidewall and a primary flame zone downstream of the burner head;

a gas inlet in the gas manifold of the burner head for connecting to and receiving gas from a gas line;

a plurality of flow-through air vents disposed around a center of the burner head and extending as continuous passageways through the gas manifold of the burner head thereby enabling core air to flow, without mixing with the gas, from an annular core space upstream of the burner head to the primary flame zone downstream of the burner head;

a plurality of premix air vents in fluid communication with the gas manifold so as to receive gas from the gas manifold for premixing air from the annular core space and gas within the gas manifold and for emitting premixed the air from the annular core space and gas into the primary flame zone;

a plurality of staging pipes extending in fluid communication with and from the gas manifold into the primary flame zone for conveying gas into the primary flame zone; and an ignition device in the primary flame zone.

12. The heater as claimed in claim 11 wherein the burner head comprises a circular head plate for mounting within a cylindrical housing and wherein the premix air vents are disposed radially outwardly of the flow-through air vents and wherein the staging pipes are disposed radially outwardly of the premix air vents.

13. The heater as claimed in claim 12 wherein the flow-through air vents, premix air vents and staging pipes are disposed in concentric circular arrangements around a center of the burner head.

14. The heater as claimed in claim 11 wherein outlets of each respective staging pipe in the burner are oriented at 25-60 degrees relative to a radial line extending from the each respective staging pipe to a center of the burner head, the outlets being oriented to swirl the gas emitted by the staging pipes.

15. The heater as claimed in claim 11 wherein outlets of each respective staging pipe in the burner are bevelled at 25-90 degrees.

16. The heater as claimed in claim 11 wherein outlets of each respective staging pipe in the burner are bevelled at 40-50 degrees.

17. The heater as claimed in claim 11 wherein outlets of each respective staging pipe in the burner are oriented at 25-35 degrees relative to a radial line extending from the respective staging pipe to a center of the burner head, the outlets being oriented to swirl the gas emitted by the pipes and wherein the outlets of each respective staging pipe in the burner are also bevelled at 40-50 degrees.

18. The heater as claimed in claim 11 wherein outlets of each respective staging pipe in the burner are oriented at 30 degrees relative to a radial line extending from the respective staging pipe to a center of the burner head, the outlets being oriented to swirl the gas emitted by the pipes and wherein the outlets of each respective staging pipe in the burner are also bevelled at 45 degrees.

19. The heater as claimed in claim 11 further comprising a flame sensor disposed on the gas line.

20. The heater as claimed in claim 11 wherein the burner comprises:

an annular air passage for secondary air to flow; and a secondary air deflector for deflecting the secondary air radially inwardly into the primary flame zone and into close proximity with gas emitted from the staging pipes.

21. A method of burning a combustible hydrocarbon gas in air while producing reduced NOx emissions, the method comprising:

supplying the combustible hydrocarbon gas through a gas inlet to a burner head defining a gas manifold including an upstream wall, a downstream wall, and a sidewall through which the gas flows into a primary flame zone downstream of the burner head through a plurality of staging pipes extending in fluid communication with and from the manifold into the primary flame zone;

flowing air through a plurality of flow-through air vents disposed in the burner head around a center of the burner head enabling core air to flow, without mixing with gas, from an annular core space upstream of the burner head through continuous passageways in the gas manifold of the burner head to the primary flame zone downstream of the burner head;

premixing a portion of the gas entering the gas manifold with air from the annular core space and emitting premixed the air from the annular core space and the portion of the gas into the primary flame zone; and igniting gas and air in the primary flame zone.

22. The method as claimed in claim 21 wherein supplying the gas comprises swirling the gas exiting the outlets of each respective staging pipe by orienting the outlets at 25-35 degrees relative to a radial line extending from the respective staging pipe to a center of the burner head.

23. The method as claimed in claim 22 wherein the supplying the gas comprises directing the gas exiting the outlets of each respective staging pipe in the burner at an angle by beveling the outlets at 40-50 degrees.

24. The method as claimed in claim 21 wherein the premixing is performed by premix air vents that are disposed radially outwardly of the flow-through air vents and wherein the supplying of the gas is performed by the staging pipes that are disposed radially outwardly of the premix air vents.

25. The method as claimed in claim 21 further comprising:

flowing secondary air through an annular air passageway; and deflecting the secondary air radially inwardly into the primary flame zone and into close proximity with gas emitted from the staging pipes.

* * * * *